US007909170B2

(12) United States Patent
Jones et al.

(10) Patent No.: US 7,909,170 B2
(45) Date of Patent: Mar. 22, 2011

(54) SELF-CLEANING SHAKER

(75) Inventors: Bradley N. Jones, Walton, KY (US); Brian S. Carr, Burlington, KY (US)

(73) Assignee: M-I L.L.C., Houston, TX (US)

( * ) Notice: Subject to any disclaimer, the term of this patent is extended or adjusted under 35 U.S.C. 154(b) by 550 days.

(21) Appl. No.: 11/859,292

(22) Filed: Sep. 21, 2007

(65) Prior Publication Data

US 2008/0078700 A1 Apr. 3, 2008

Related U.S. Application Data

(60) Provisional application No. 60/827,560, filed on Sep. 29, 2006.

(51) Int. Cl.
*B07B 1/55* (2006.01)

(52) U.S. Cl. ..... 209/380; 209/17; 209/250; 209/259

(58) Field of Classification Search ..... 209/379, 209/380, 17, 250, 259; 210/409, 411, 412
See application file for complete search history.

(56) References Cited

U.S. PATENT DOCUMENTS 5,051,166 A * 9/1991 Heimhard et al. ..... 209/269
5,190,645 A 3/1993 Burgess
5,462,673 A * 10/1995 Piers ..... 210/739
5,896,997 A * 4/1999 Tanner ..... 209/269
6,070,738 A * 6/2000 Lyman et al. ..... 209/457
6,186,340 B1 * 2/2001 Hirs ..... 210/411
6,355,167 B1 * 3/2002 Wensauer ..... 210/232
6,517,733 B1 * 2/2003 Carlson ..... 210/785
6,662,952 B2 12/2003 Adams et al.
6,823,238 B1 * 11/2004 Hensley et al. ..... 700/273
6,976,592 B1 12/2005 Svehaug
7,219,805 B2 * 5/2007 DeMaison ..... 209/246
7,571,817 B2 * 8/2009 Scott et al. ..... 209/413

OTHER PUBLICATIONS

Notification of Transmittal of the International Search Report and the Written Opinion of the International Searching Authority or the Declaration, Dated Feb. 4, 2008, 10 pages, Application No. PCT/US2007/079386.

* cited by examiner

*Primary Examiner* — Joseph C Rodriguez

(57) ABSTRACT

A vibratory separator including a housing having a drilling material inlet and at least one basket, at least one screen assembly configured to be disposed in the at least one basket, an actuator connected to the at least one basket, wherein the actuator provides vibratory motion to the at least one basket, a sump configured to receive drilling material that passes through the at least one screen assembly, and at least one spray nozzle for cleaning the vibratory separator is disclosed. A method for cleaning a vibratory separator including providing instructions to a programmable logic controller to activate at least one spray nozzle disposed on the vibratory separator is also disclosed. A method of retrofitting a vibratory separator including installing at least one spray nozzle in a vibratory separator, installing a programmable logic controller on the vibratory separator, and providing instructions to the programmable logic controller to activate at least one spray nozzle disposed on the vibratory separator is disclosed.

18 Claims, 3 Drawing Sheets

SELF-CLEANING SHAKER

The present application claims priority to U.S. Provisional Patent Application Ser. No. 60/827,560, filed on Sep. 29, 2006, and is hereby incorporated by reference in its entirety.

BACKGROUND

1. Field of the Disclosure

The present disclosure generally relates to methods and apparatuses for cleaning vibratory shakers and vibratory shaker components. More specifically, the present disclosure relates to automated methods and apparatuses for cleaning vibratory shakers and vibratory shaker components.

2. Background

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breeched. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

Apparatus in use today to remove cuttings and other solid particulates from drilling fluid are commonly referred to in the industry as "shale shakers." A shale shaker, also known as a vibratory separator, is a vibrating sieve-like table upon which returning solids laden drilling fluid is deposited and through which clean drilling fluid emerges. Typically, the shale shaker is an angled table with a generally perforated filter screen bottom. Returning drilling fluid is deposited at the feed end of the shale shaker. As the drilling fluid travels down the length of the vibrating table, the fluid falls through the perforations to a reservoir below leaving the solid particulate material behind. The vibrating action of the shale shaker table conveys solid particles left behind until they fall off the discharge end of the shaker table. The above described apparatus is illustrative of one type of shale shaker known to those of ordinary skill in the art. In alternate shale shakers, the top edge of the shaker may be relatively closer to the ground than the lower end. In such shale shakers, the angle of inclination may require the movement of particulates in a generally upward direction. In still other shale shakers, the table may not be angled, thus the vibrating action of the shaker alone may enable particle/fluid separation. Regardless, table inclination and/or design variations of existing shale shakers should not be considered a limitation of the present disclosure.

Preferably, the amount of vibration and the angle of inclination of the shale shaker table are adjustable to accommodate various drilling fluid flow rates and particulate percentages in the drilling fluid. After the fluid passes through the perforated bottom of the shale shaker, it can either return to service in the borehole immediately, be stored for measurement and evaluation, or pass through an additional piece of equipment (e.g., a drying shaker, centrifuge, or a smaller sized shale shaker) to further remove smaller cuttings.

As drilling fluid is processed, residual drilling waste (e.g., high density fluids and particulate matter), may become stuck or entrained on the shaker screens and other internal shaker components. As the amount of residual drilling waste increases, the efficiency of the shale shaker may decrease due to, for example, clogged screens, clogged outlet lines, and/or "gummed up" internal components. To maintain shaker efficiency, the residual drilling waste must be removed from the shaker components.

Presently, methods for removing the residual waste include manual spraying of the internal components. These processes are both time intensive and labor intensive.

Accordingly, there exists a need for a shale shaker cleaning system that decreases the amount of time the shaking apparatus is out of commission. Additionally, there exists a need for an automated process that decreases the amount of manual labor required to clean the system.

SUMMARY OF THE DISCLOSURE

In one aspect, embodiments disclosed herein relate to a vibratory separator including a housing having a drilling material inlet and at least one basket, at least one screen assembly configured to be disposed in the at least one basket, an actuator connected to the at least one basket, wherein the actuator provides vibratory motion to the at least one basket, a sump configured to receive drilling material that passes through the at least one screen assembly, and at least one spray nozzle for cleaning the vibratory separator.

In another aspect, embodiments disclosed herein relate to method for cleaning a vibratory separator including providing instructions to a programmable logic controller to activate at least one spray nozzle disposed on the vibratory separator.

In another aspect, embodiments disclosed herein relate to a method of retrofitting a vibratory separator including installing at least one spray nozzle in a vibratory separator, installing a programmable logic controller on the vibratory separator, and providing instructions to the programmable logic controller to activate at least one spray nozzle disposed on the vibratory separator.

Other aspects and advantages of the invention will be apparent from the following description and the appended claims.

DETAILED DESCRIPTION

Generally, embodiments disclosed herein relate to apparatuses and methods for cleaning vibratory shakers. Furthermore, apparatuses and methods disclosed herein may include at least one spray nozzle and/or vibratory sump for the automated cleaning of vibratory shakers.

Figure 1:
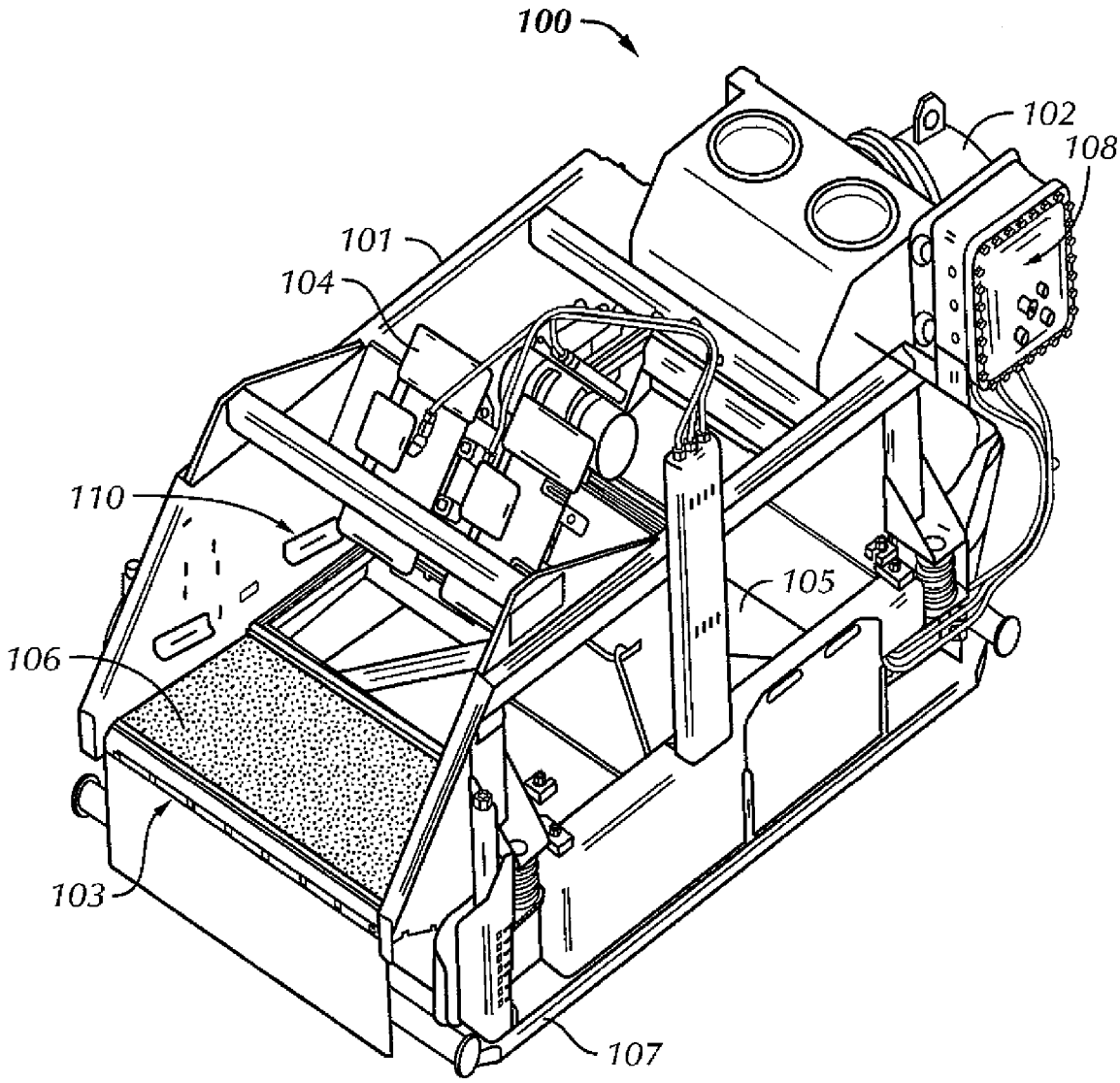
FIG. 1 is a top perspective view of a vibratory separator in accordance with an embodiment of the present disclosure.

Referring initially to FIG. 1, a top perspective view of a vibratory separator 100 in accordance with one embodiment of the present disclosure is shown. In this embodiment, vibratory separator 100 includes a housing 101 defining a drilling material inlet 102, a drilling material discharge area 103, and an inner section 110. Vibratory separator 100 also includes at least one actuator 104 (e.g., a motor, a motor system, or a motor control device). In this embodiment, actuator 104 is coupled to a rotary motor (not shown), which upon engagement, imparts a vibratory motion to a basket 105 that is disposed within housing 101.

Securely attached to basket 105 is at least one screen assembly 106. Screen assembly 106 is secured, such that as actuator 104 is engaged, and vibratory basket 105 begins to vibrate, screen assembly 106 will not loosen from basket 105. Screen assembly 106 may be made from any material known to one of ordinary skill in the art including, but not limited to, steel, composite, mesh, and cloth. Moreover, screen assembly 106 may be connected to vibratory separator 100 by any connection type known to one of ordinary skill in the art including, for example, pretension and/or hookstrip assemblies.

Located below screen assembly 106 is a sump 107. As drilling material, including liquid state and solid state particulate matter, flows through screen assembly 106, the drilling material may collect in sump 107. When sump 107 becomes full, or at the discretion of the drilling operator, sump 107 may be emptied through an outlet (not shown). In alternate embodiments, the outlet to sump 107 may include a valve for retaining drilling waste in sump 107. Thus, sump 107 may serve as a means for collecting drilling material that has passed through screen assembly 106, as well as serving as a storage vessel for separated drilling material prior to downstream processing.

As drilling material collects in the bottom of vibratory separator 100, some material may become stuck to the sidewalls and bottom of sump 107. To prevent the build up of material in sump 107, in certain embodiments, sump 107 may be attached to actuator 104 to providing vibratory motion to sump 107. As vibratory motion is applied to sump 107, material stuck to the sidewalls and bottom of sump 107 may be dislodged, thereby allowing the material to exit vibratory separator 100 through the outlet (not shown). In alternate embodiments, the vibratory motion to sump 107 may be provided through an alternate actuator disposed either internal or external to vibratory separator 100. That is, separate actuators may provide vibratory motion to basket 105 and sump 107.

While vibratory motion may dislodge material from the sidewalls and bottom of sump 107, in certain embodiments, material may be stuck to sump 107 so that vibratory motion alone will not dislodge the material. In such embodiments, nozzles (not shown) disposed on inner section 110 of vibratory separator 100 may provide a cleaning fluid to assist in removing the material from sump 107. The cleaning fluid may include water, surfactants, steam, and/or any other dissolving fluids known to those of ordinary skill in the art. In certain embodiments, the cleaning fluid may be pressurized or heated to further assist in removing drilling material from sump 107. Thus, vibratory separators 100 in accordance with embodiments of the present disclosure may also include attachments for pressurization units (e.g., compressors) and/or heating units (e.g., boilers). Additionally, vibratory separator 100 may also include a programmable logic controller ("PLC") 108. PLC 108 may include instructions for running actuators 104, nozzles, pressurization units, heating units, vibratory sump actuators, or any other process that may require instructions for automation. However, in other embodiments, the nozzles, pressurization units, heating units, sump actuators, and other processes may be controlled manually through the use of, for example, manually valves or control switches.

Figure 2:
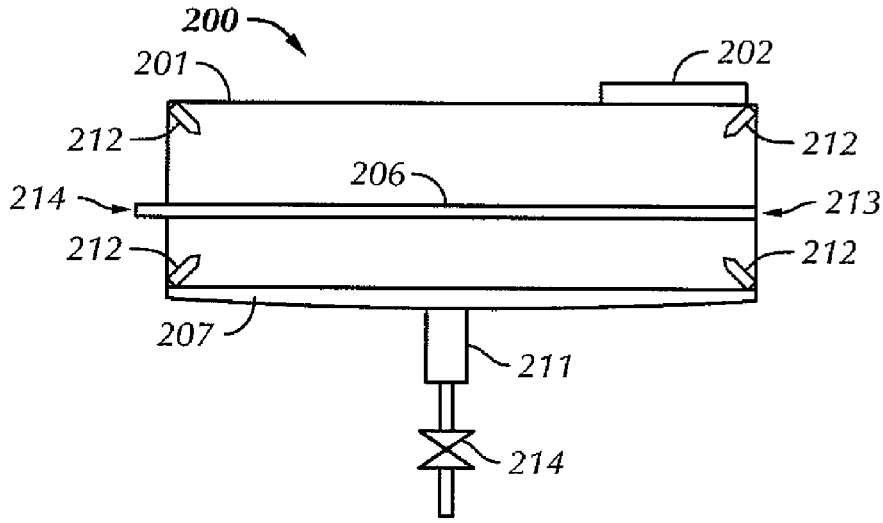
FIG. 2 is a cross sectional view of an alternate vibratory separator in accordance with an embodiment of the present disclosure.

Now referring to FIG. 2, a cross sectional view of an alternate vibratory separator 200 in accordance with one embodiment of the present disclosure is shown. In this embodiment, vibratory separator 200 includes a housing 201, a drilling material inlet 202, a screen assembly 206, a sump 207, and an outlet 211. Additionally, the present embodiment includes a plurality of nozzles 212 disposed along the interior of housing 201. As drilling material enters vibratory shaker 200 through inlet 202, the drilling material falls onto screen assembly 206 and is conveyed from an inlet end 213 toward a discharge end 214 using vibratory motion as described above. As screen assembly 206 vibrates, residual drilling fluid and small particulate matter may fall through screen assembly 206 into sump 207. As drilling material sticks to and collects to sump 207, the drilling material may begin to clog outlet 211 or otherwise prevent the flow of drilling material to downstream processing equipment. In certain embodiments, one of ordinary skill in the art will appreciate that the addition of a valve 214 on outlet 211 may help a drilling operator control the flow of drill material from sump 207.

In such an embodiment, when sump 207 is substantially full of drilling material, or at a time interval as determined by the drilling operator, valve 214 may be opened to allow the drilling material to exit sump 207. Before, during, and/or after opening valve 214, thereby allowing drilling material to flow from sump 207, a flow of cleaning fluid may be provided from nozzles 212. In this embodiment, nozzles 212 are illustrated disposed in the corners of housing 201 of vibratory separator 200. As such, nozzles 212 are directed to provide a flow of cleaning fluid over screen assembly 206. However, one of ordinary skill in the art will appreciate that nozzles 212 may be positioned to direct a flow of cleaning fluid to any surface area on the interior of housing 201, including, but not limited to, screen assembly 206, sump 207, outlet 211, and any additional areas that may be present in vibratory separator 200.

In an alternate embodiment, valve 214 may remain open during the operation of vibratory separator 200 to allow a continuous flow of drilling material from vibratory separator 200 to downstream equipment. In such an embodiment, drilling material may continue to flow from vibratory separator 200, and nozzles 212 may be activated when sump 207 begins to overflow, when outlet 211 become clogged, and/or when screen assembly 206 becomes coated with drilling material such that the flow of drilling material therethrough is impeded. In either of the above mentioned embodiments, one of ordinary skill in the art will appreciate that the cleaning provided by the directed spray of cleaning fluid from nozzles 212 to the interior of vibratory separator 200 may be further enhanced by providing a vibratory motion to sump 207, as discussed above.

Figure 3:
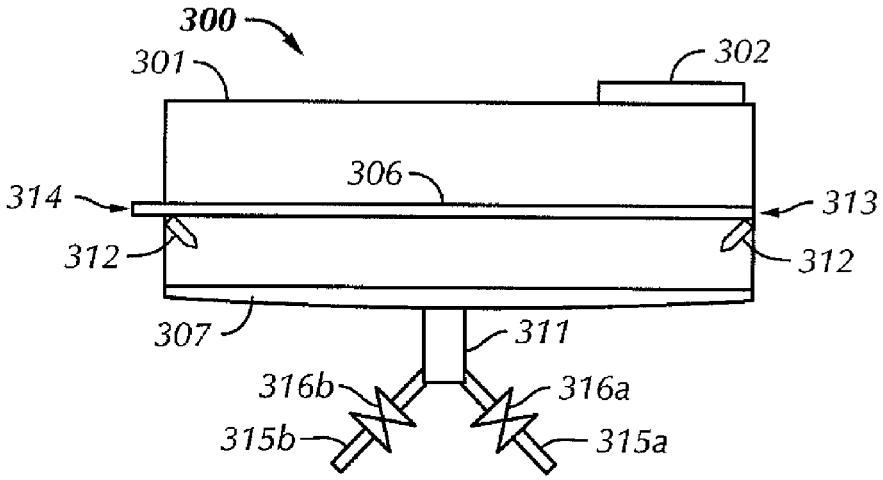
FIG. 3 is a cross sectional view of a vibratory separator in accordance with an embodiment of the present disclosure.

Referring to FIG. 3, a cross sectional view of a vibratory separator 300 in accordance with another embodiment of the present disclosure is shown. In this embodiment, vibratory separator 300 includes a housing 301, a drilling material inlet 302, a screen assembly 306, a sump 307, and an outlet 311. Additionally, the present embodiment includes a plurality of nozzles 312 disposed along the interior of housing 301. As illustrated, outlet 311 includes a plurality of valves 316 which may be actuated to direct an exiting flow of drilling material from vibratory separator 300 to either downstream processing equipment and/or a remediation device.

Outlet 311 is separated into two directional outlet lines 315 including a line that leads to downstream processing equipment 315*a*, and a line that leads to a remediation device 315*b*. The flow of material through each outline line 315 may be controlled with corresponding outline line valves 316*a* and 316*b*. As drilling material enters vibratory shaker 300 through inlet 302, the drilling material falls onto screen assembly 306 and is conveyed from an inlet end 313 toward a discharge end 314 using vibratory motion as described above. As screen assembly 306 vibrates, residual drilling fluid and small particulate matter may fall through screen assembly 306 into sump 307. As drilling material sticks to and collects to sump 307, the drilling material may begin to clog outlet 311. In systems wherein drilling material is allowed to continuously flow out of vibratory separator 300, as well as in systems where the flow of drilling material is controlled by valves 316, one of ordinary skill in the art will appreciate that it may be desirable to prevent the contamination of drilling material to be recycled from the cleaning fluids used to clean vibratory separator 300.

To prevent the contamination of drilling material to be recycled from cleaning fluids, a series of valves may be used to control the flow of fluids and particulate matter from vibratory separator 300. In such an embodiment, during the normal operation of cleaning drilling fluid, outlet valve 316*b* may remain closed to prevent the flow of drilling materials through outline line 315*b*, while outlet valve 316*a* may remain open to allow the flow of drilling materials through outline line 315*a*. As sump 307 becomes clogged with drilling material, or at a specified cleaning interval as determined by a drilling operator, valve 316*a* may be closed to prevent the flow of drilling materials therethrough, while valve 316*b* is opened to allow cleaning fluids to flow to remediation equipment (not shown). By allowing drilling material that may be recycled into reusable drilling fluid to remain separate from cleaning materials that may include substances that may damage the drilling fluid properties, the integrity of the drilling material may be maintained.

Additionally, nozzles 312 in vibratory separator 300 are disposed under screen assembly 306 to allow the direct flow of cleaning fluid into sump 307. In this embodiment, a high pressure flow of cleaning fluid may further assist in cleaning the area under screen 306, as well as sump 307. One of ordinary skill in the art will appreciate that any nozzle placement and or sump, including vibratory sumps, may be used in accordance with the above described embodiment. Furthermore, the nozzles may include non-vibrating nozzles that spray in one general direction and fixed vibrating nozzles that may direct cleaning fluid over a respectively wider area. One of ordinary skill in the art will appreciate that certain embodiments may include any number of fixed vibrating and/or non-vibrating nozzles to cover a specified portion of the interior of vibratory separator 300. Additionally, modifications to the nozzles, or nozzle attachment points may allow nozzles to move along an interior or exterior surface of housing 301 of vibratory separator 300. Thus, in at least one embodiment, cleaning fluid may be directed to cover substantially the entire interior surface of vibrating separator 300 by using a plurality of fixed vibrating and/or non-vibrating nozzles.

Figure 4:
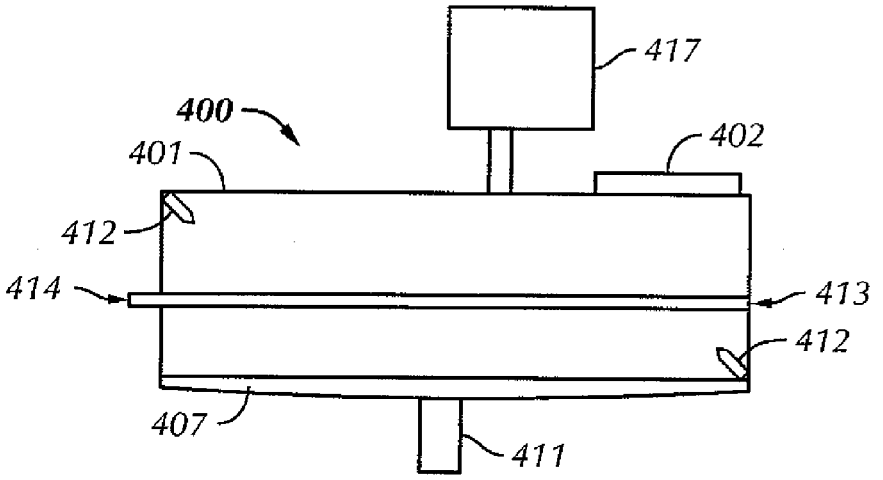
FIG. 4 is a cross sectional view of a vibratory separator in accordance with an embodiment of the present disclosure.

Referring now to FIG. 4, a cross sectional view of a vibratory separator 400 in accordance with one embodiment of the present disclosure is shown. In this embodiment, vibratory separator 400 includes a housing 401, a drilling material inlet 402, a screen assembly 406, a sump 407, and an outlet 411. Additionally, vibratory separator 400 includes a fume hood/outlet 417 connected to housing 401. As drilling material enters vibratory shaker 400 through inlet 402, the drilling material falls onto screen assembly 406 and is conveyed from an inlet end 413 toward a discharge end 414 using vibratory motion as described above. As screen assembly 406 vibrates, residual drilling fluid and small particulate matter may fall through screen assembly 406 into sump 407. To clean vibratory separator 400, a plurality of nozzles 412 may be activated to direct a flow of cleaning fluid over interior components of vibratory separator 400. While residual fluids and particulate matter generally fall through screen assembly 406, and while drilling waste is discharged via discharge end 414, a pressurized flow of cleaning fluid may cause the aeration of some of the residual fluids and particulate matter in the form of, for example, suspended particulate matter.

In embodiments wherein the pressurized flow of water is heated, a directed flow of cleaning fluid may promote the aeration of potentially hazardous materials including, for example, hydrogen sulfide ("$H_2S$") fumes. To prevent such fumes and aerated materials from escaping vibratory separator 400, housing 401 may include fume hood/outlet 417. As fumes and aerated particles are ejected in a generally upward direction, fume hood/outlet 417 may pull the aerated particles and fumes inward, thereby trapping the potentially hazardous fumes and/or aerated particles. One of ordinary skill in the art will appreciate that fume hood/outlet 417 may be turned on during any step of the separation process including during normal separation, during cleaning, or substantially continuously. Thus, embodiments including fume hood/outlets 417 may provide for a vibratory separator 400 that is substantially enclosed, thereby preventing the escape of hazardous materials and/or aerated particulate matter into the drilling work space.

Figure 5:
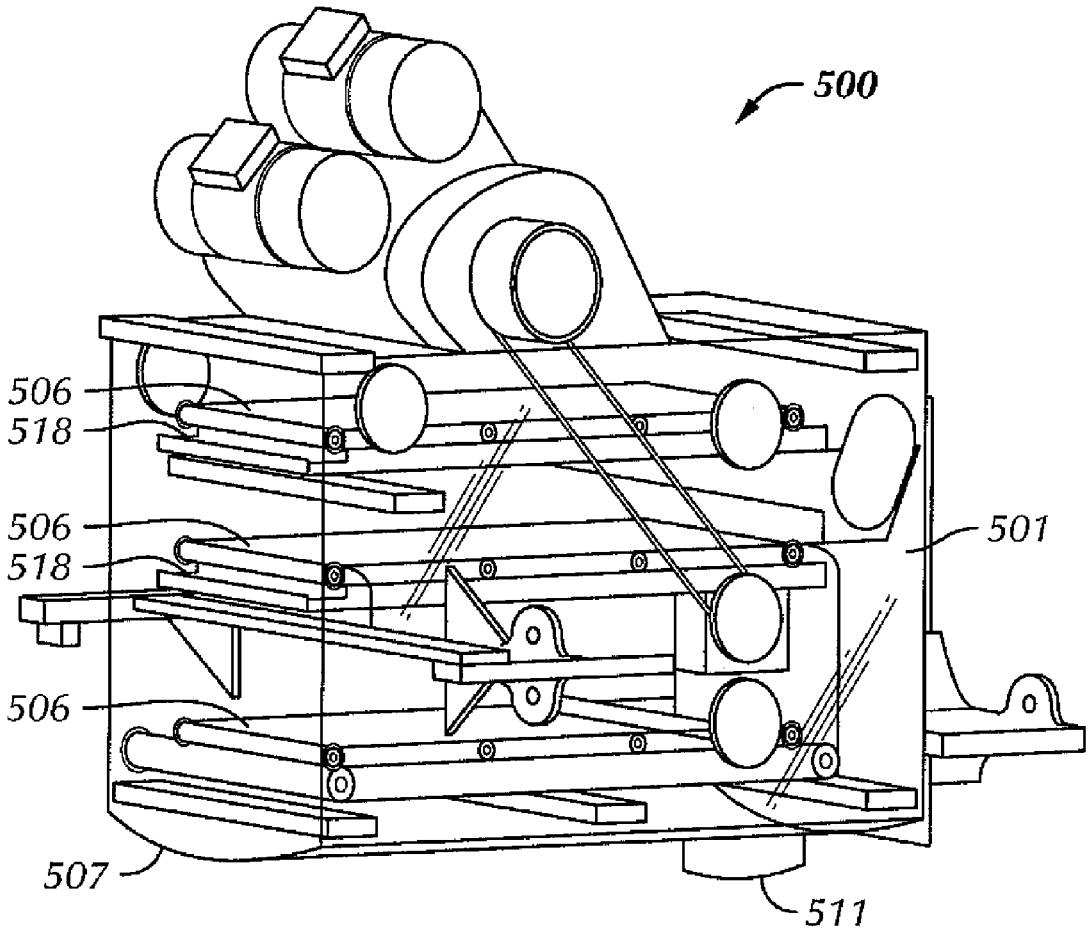
FIG. 5 is a side perspective view of a vibratory separator in accordance with an embodiment of the present disclosure.
Figure 6:
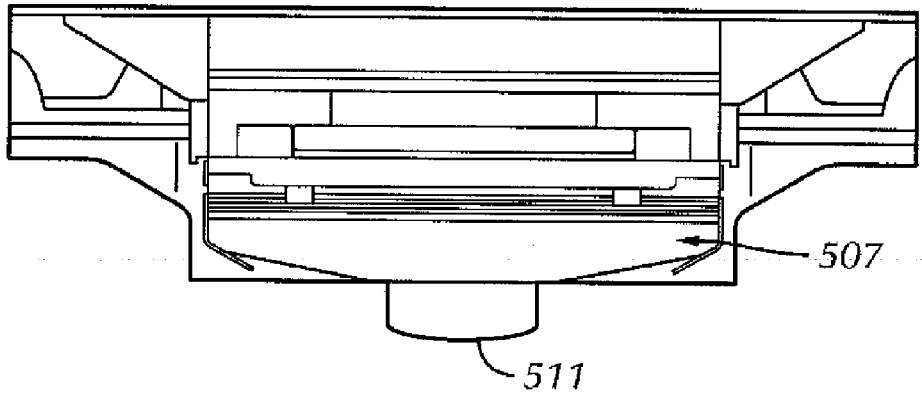
FIG. 6 is a cross sectional view of a vibratory separator in accordance with an embodiment of the present disclosure.

Referring to FIGS. 5 and 6 together, a side perspective and cross sectional view of a vibratory separator 500 in accordance with an alternate embodiment of the present disclosure are shown. In this embodiment, vibratory separator 500 includes a housing 501, a plurality of screen assemblies 506, a sump 507, and an outlet 511. In this embodiment, vibratory separator 500 includes a multi-tier configuration of screen assemblies 506. By vertically stacking multiple screen assemblies 506, the footprint of vibratory separator 500 is decreased, thereby providing equivalent separating potential while requiring less space. In vibratory separators 500 using vertically stacked screen assemblies 506, the size of the apertures in the screens may be varied according to each tier. As drilling material begins to flow from a top tier of vibratory separator 500, the screen assembly apertures may be substantially greater in size than the apertures of lower screen assemblies. To prevent drilling fluid from falling on lower disposed screen assemblies 506, a series of flowback pans 518 may be located under screen assemblies 506. Flowback pans 518 may be directed to deposit drilling material into sump 507, thereby allowing drilling material to be substantially cleaner at each level of processing.

As described above, vibratory separator 500 may include nozzles (not shown) or a fume hood/outlet (not shown) to further assist in cleaning the interior of vibratory separator 500. One of ordinary skill in the art will appreciate that any of the above described methods for cleaning vibratory separators may be used in multiple tier screen assembly vibratory separators in accordance with embodiments disclosed herein.

Embodiments disclosed herein may include a PLC to provide instructions for the automation of vibratory separation and cleaning of a vibratory separator. In one embodiment, the PLC may provide instructions to the vibratory separator to activate a cleaning system according to a selected time interval. The selected time interval may be determined by a drilling operator, or may be selected from a pre-programmed set of instructions for cleaning the vibratory separator at a preselected interval. In such embodiments, one of ordinary skill in the art will appreciate that the cleaning cycle may be activated automatically or on an as-needed basis as is determined by the drilling operator.

In alternate embodiments, the PLC may provide instructions to the vibratory separator to activate a pre-programmed routine for activating the flow of a cleaning fluid through nozzles, directing the nozzles, or changing the cleaning fluid dispersed by the nozzles. Additionally, the PLC may provide instructions to activate a vibratory motion in a sump as part of a pre-programmed cleaning routine. While programmed time intervals and routines may assist in cleaning the vibratory separator, certain embodiments may require more exact cleaning instructions for providing efficient cleaning.

In one embodiment, a programmable logic controller may provide instructions to at least one nozzle when a vibratory performance parameter of the vibratory separator falls below a specified performance level. A vibratory performance parameter may include, for example, a drilling material discharge rate, a sump level, a processing rate, or any other parameter that may effect the efficiency of a vibrating separation operation as known to those of ordinary skill in the art.

In an embodiment wherein drilling material discharge rate is measured to determine a performance parameter, the quantity of drilling material discharged from the vibratory separator during a specified time interval may be measured. In certain embodiments, a decreased discharge rate may indicate that screen assemblies are clogged with particulate matter and/or that internal components are coated with drilling material so as to slow the vibratory operation. If the rate of discharge falls below a specified level, the PLC may receive indication (e.g., an input or signal) that the vibratory separator is not operating within a specified performance level, and may decide whether to initiate a cleaning cycle, or otherwise inform a drilling operator of such condition.

In alternate embodiments, the PLC may monitor a sump level. In such an embodiment, a level indicator may be disposed in the sump, and when drilling material reaches the level of the indicator, the PLC may receive a signal that the sump is full. Upon receiving such signal, the PLC may then determine whether to initiate a cleaning cycle, or otherwise inform a drilling operator of such condition. In certain embodiments, multiple performance parameters may be monitored to provide the PLC additional information to be used in determining whether to initiate a cleaning cycle. By basing such decision on multiple performance parameters, one of ordinary skill in the art will realize that the chance of false readings that a performance parameter has fallen below a specified level will be reduced. Thus, the overall efficiency of the system may be increased by minimizing downtime due to unnecessary cleaning cycles.

One of ordinary skill in the art will appreciate that providing instructions to a PLC for determining a performance parameter of a vibratory separator and installing spray nozzles to activate accordingly may be retrofitted onto existing vibratory separators. One method of retrofitting a vibrating separator may including installing at least one spray nozzle on an existing vibratory separator and installing a PLC on the vibratory separator to provide instructions to activate the at least one spray nozzle. Thus, an existing vibratory separator may be modified to include the efficiency advantages of the present disclosure. One of ordinary skill in the art will further realize that any of the additional modifications including, for example, a vibrating sump and/or a fume hoot/outlet, may also be retrofitted onto an existing vibratory separator to further increase the efficiency of a system.

In other embodiments, a PLC may provide instructions to actuate spray nozzles at different locations within the vibratory separator according to a predetermined sequence. Exemplary sequencing may include actuating nozzles to clean the inside of the vibratory separator first, then actuating nozzles inside the sump second. Such a sequence may increase the efficiency of the cleaning operation by cleaning different sections of the separator at different times. Such sequencing may be further enhanced by including sequencing operations with the time based intervals discussed above.

Advantageously, embodiments disclosed herein provide apparatuses and methods for cleaning vibratory separators. Because the vibratory separator does not need to be taken apart to clean the internal components, the process of cleaning the separator is faster, thereby resulting in less downtime. Additionally, the cleaning process may be automated so as to remove the manual labor component of the process. Because embodiments in accordance with the present disclosure may be automated to clean the internal components of a vibratory separator according to a specified time interval or process cycle, the vibrating separator may continuously work at a more efficient level.

Furthermore, advantageously, embodiments in accordance with the present disclosure may include PLC's that provide instructions to nozzles for cleaning processes according to vibratory performance parameters of the vibratory separator. Because the vibratory separator may begin a self-cleaning cycle, or otherwise inform a drilling operator when the separator is functioning below a performance level, a problem may be corrected before it substantially effects system performance. Thus, vibratory shakers in accordance with the present disclosure may help maintain efficient discharge rates, thereby increasing the efficiency of the drilling operations.

Moreover, embodiments of the present disclosure may include multiple means for emptying the sump, thereby separating recyclable drilling material from drilling material to be sent to remediation. Because recyclable drilling material is separated from cleaning products, the integrity of the drilling material is maintained, thereby further decreasing the cost of drilling operations by allowing a greater quantity of drilling fluid reuse. Finally, advantageously, vibrating separators in accordance with embodiments disclosed herein may include body housings that have fume hood/outlets as well as sumps to trap drilling material whether in solid, liquid, or gaseous state. Because the vibrating separators include methods for trapping aerated particulate matter and potentially hazardous gases generated by the cleaning process, the vibrating operation may be safer and less environmentally damaging.

While the present disclosure has been described with respect to a limited number of embodiments, those skilled in the art, having benefit of the present disclosure will appreciate that other embodiments may be devised which do not depart from the scope of the disclosure described herein. Accordingly, the scope of the disclosure should be limited only by the claim appended hereto.

What is claimed is:

1. A vibratory separator comprising:

a housing comprising a drilling material inlet and at least one basket;

at least one screen assembly configured to be disposed in the at least one basket;

an actuator connected to the at least one basket, wherein the actuator provides vibratory motion to the at least one basket;

a sump configured to receive drilling material that passes through the at least one screen assembly;

at least one spray nozzle for directing cleaning fluid into the vibratory separator;

a first line for directing drilling material from the sump;

a second line for directing cleaning fluid from the sump; and a valve actuable to direct cleaning fluid through the second line.

2. The vibratory separator of claim 1 further comprising a programmable logic controller to provide instructions to the at least one spray nozzle.

3. The vibratory separator of claim 2, wherein the programmable logic controller provides instructions to activate the at least one spray nozzle when a vibratory performance parameter of the vibratory separator falls below a specified performance level.

4. The vibratory separator of claim 3, wherein the vibratory performance parameter comprises a discharge rate.

5. The vibratory separator of claim 4, wherein the vibratory performance parameter comprises a sump level.

6. The vibratory separator of claim 2, wherein the programmable logic controller provides instructions to activate the at least one spray nozzle according to a selected time interval.

7. The vibratory separator of claim 2, wherein the programmable logic controller provides instructions to activate the at least one spray nozzle according to a process cycle.

8. The vibratory separator of claim 2, wherein the programmable logic controller provides instructions to activate the at least one spray nozzle according to a predetermined sequencing operation.

9. The vibratory separator of claim 1, wherein the at least one spray nozzle is configured to spray the at least one screen assembly.

10. The vibratory separator of claim 1, wherein the at least one spray nozzle is configured to spray the sump.

11. The vibratory separator of claim 1, wherein the sump further comprises an outlet fluidly connected to downstream processing equipment for further processing of drilling material.

12. The vibratory separator of claim 1 further comprising a flowback channel disposed below the at least one screen assembly and fluidly connected to the sump.

13. The vibratory separator of claim 1, wherein the at least one spray nozzle is a fixed vibrating spray nozzle.

14. The vibratory separator of claim 1, wherein the at least one spray nozzle is non-vibrating.

15. The vibratory separator of claim 1, wherein the housing substantially encloses the vibratory separator.

16. The vibratory separator of claim 1, wherein the housing further comprises a fume hood.

17. The vibratory separator of claim 1, wherein the sump is vibrative.

18. The vibratory separator of claim 1, wherein a flow of fluid through the at least one spray nozzle is controlled by a manual valve.

* * * * *